United States Patent [19]

Elek et al.

[11] 3,934,614

[45] Jan. 27, 1976

[54] ENERGY DISSIPATOR RING

[76] Inventors: Zoltan Elek, 19222 Sierra Isabelle Road, Irvine, Calif. 92664; George M. Paulsen, 3936 W. 177th St., Torrance, Calif. 90504

[22] Filed: Sept. 23, 1974

[21] Appl. No.: 508,722

[52] U.S. Cl. ..... 138/44; 138/108; 138/178

[51] Int. Cl.[2] ..... F15D 1/04

[58] Field of Search ..... 138/37, 44, 97, 98, 103, 138/108, 177, 178; 61/10–13

[56] References Cited

UNITED STATES PATENTS

| | | | |
|---|---|---|---|
| 384,860 | 6/1888 | Meehan | 138/102 X |
| 3,474,832 | 10/1969 | Broadhead et al. | 138/97 |
| 3,516,446 | 6/1970 | O'Hargan et al. | 138/97 |
| 3,840,053 | 10/1974 | Sluga | 138/97 |

*Primary Examiner*—Richard C. Queizzer
*Assistant Examiner*—Charles Gorenstein
*Attorney, Agent, or Firm*—Joseph E. Szabo

[57] ABSTRACT

Prefabricated rings comprising several arcuate sections and an expansion device are installed and frictionally retained in an inclined water conduit so as to dissipate the energy of the water descending therein, thereby slowing it to a velocity at which conduit wear and erosion and other harmful effects by the water in the conduit are acceptable.

6 Claims, 14 Drawing Figures

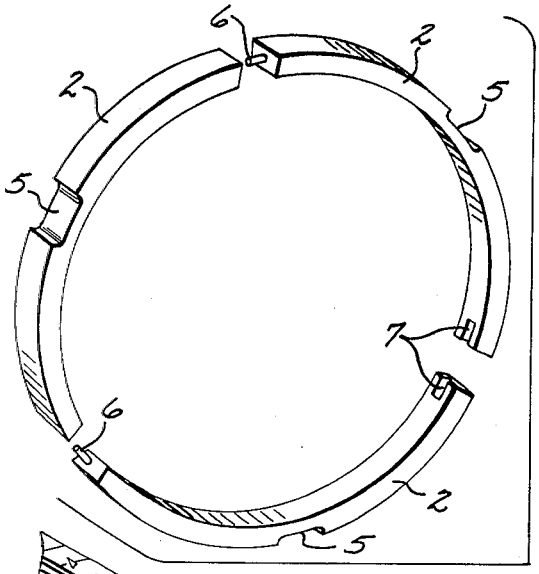
FIG. 1
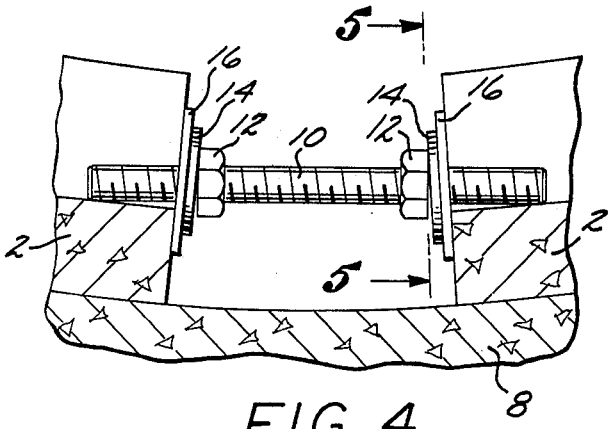
FIG. 4
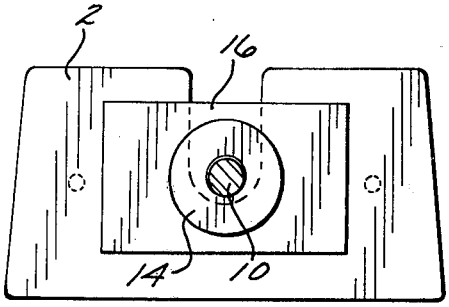
FIG. 5
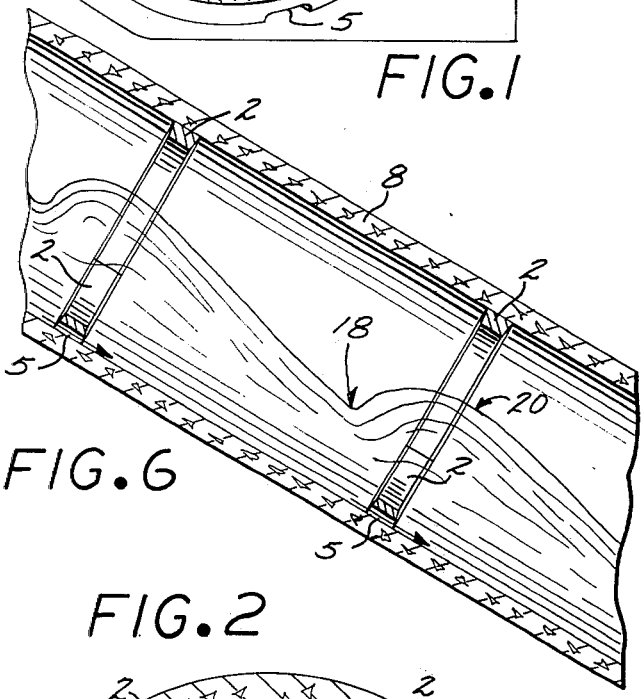
FIG. 6
FIG. 2
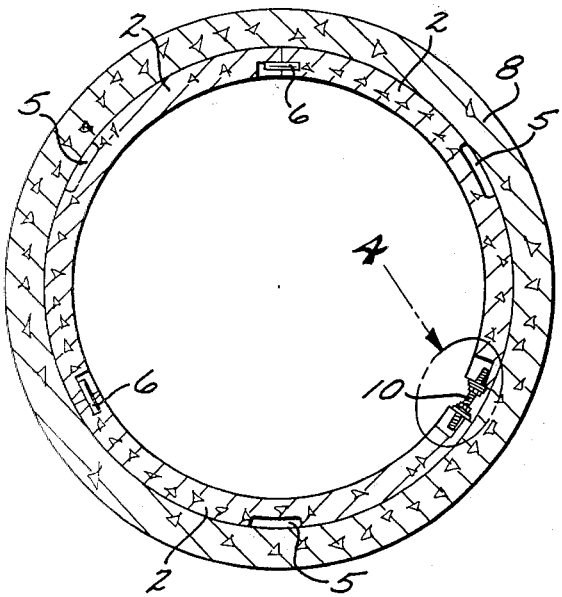
FIG. 3
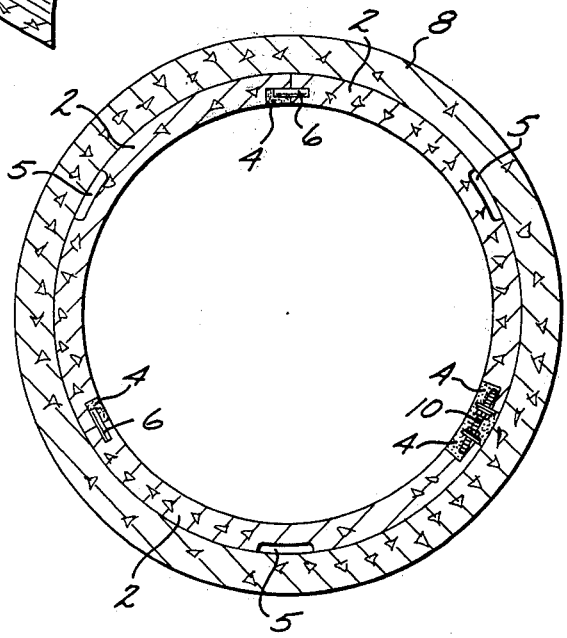

FIG. 7
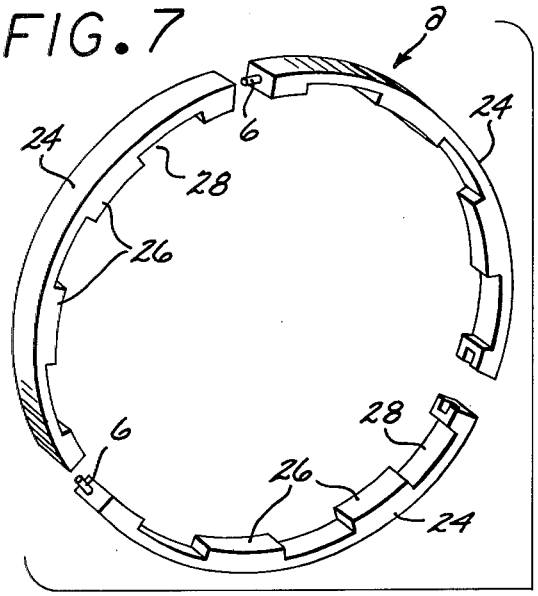
FIG. 8
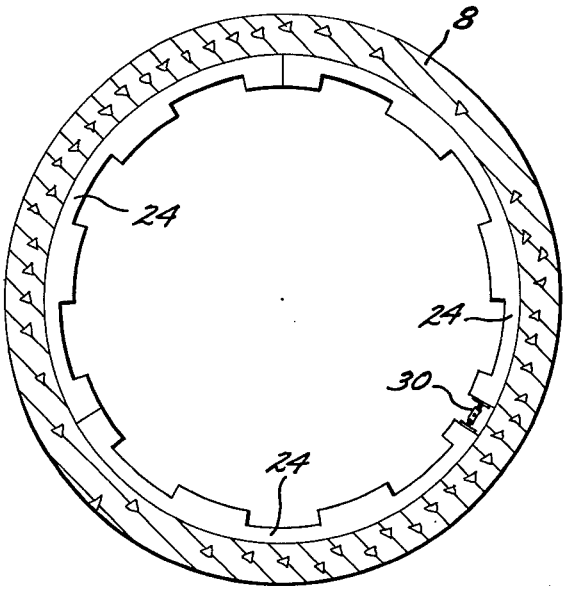
FIG. 9
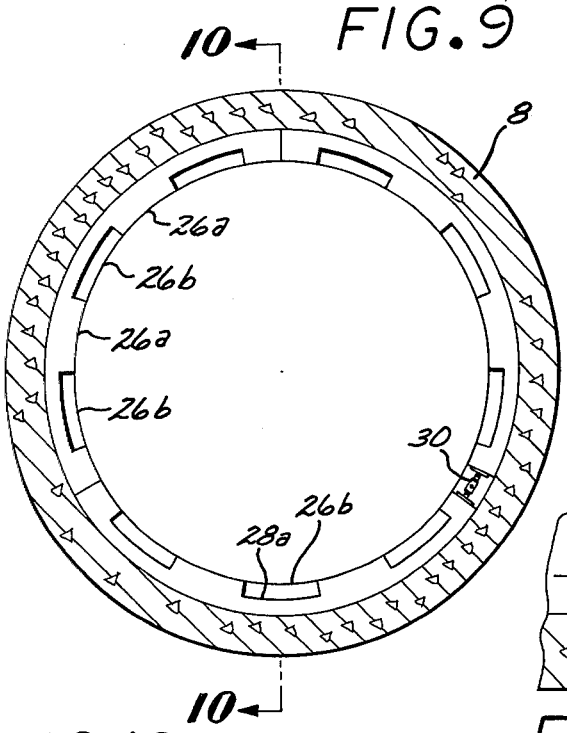
FIG. 11
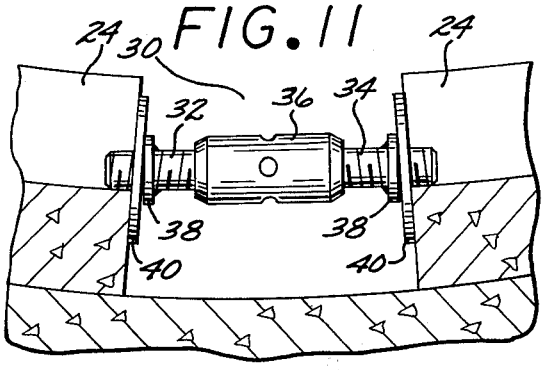
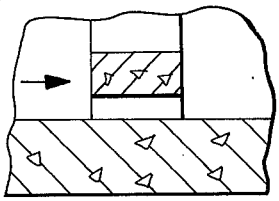
FIG. 12
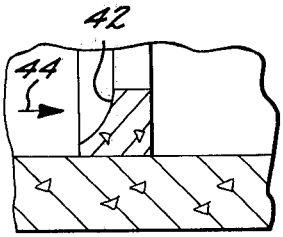
FIG. 13
FIG. 10
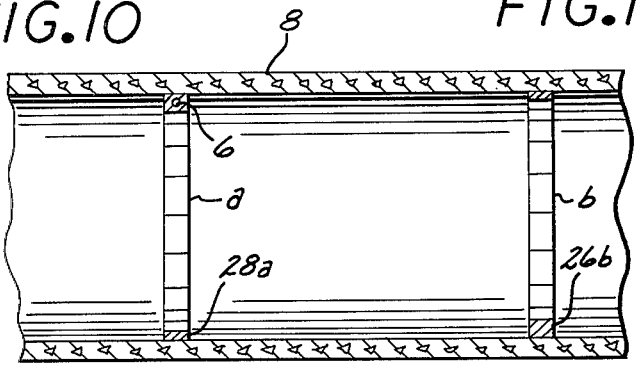
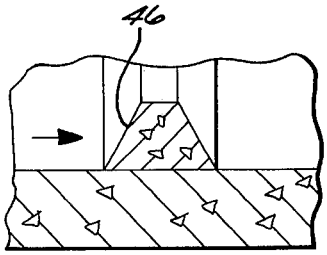
FIG. 14

ENERGY DISSIPATOR RING

Whenever a water conduit is constructed on a steep gradient, the water which flows in the conduit accelerates as it flows down the conduit until the frictional force between the water and the conduit comes to an equilibrium with the gravitational force. Normally, particularly with conduits of large diameter, the water velocity at which this equilibrium occurs is sufficiently high that one or more of the following problems will occur: (1) excessive erosion at the outlet of the pipe; (2) water velocity unacceptably high for downstream facilities; (3) the structural integrity of the conduit becomes endangered by the erosive effects of the high velocity water containing silt and debris.

Almost all methods of dealing with the above problems have been curative rather than preventative. Thus, large expensive transition structures have been constructed at the bottom of steeply sloped conduits and such conduits are often constructed with special walls which are exceptionally thick to allow for the additional scouring that will occur.

A better approach to the problem is to remove the cause, i.e., high water velocity, rather than to tolerate the problem caused thereby. This approach requires that the over-all frictional retardance in the conduit be increased so that it becomes equal to the gravitational force that tends to accelerate the water flow. One method of providing such additional retardance in a conduit is to install rings within the conduit. The rings create turbulance in the water, and by thus dissipating some of the energy in the descending water, causes the flow velocity to be reduced.

Until now, the only method of providing energy-dissipating rings in conduits would have been accomplished by either modifying the conduit production procedure or by altering standard conduits. Modification of the standard conduit production procedure has been time-consuming and expensive, since it does not conform to modern mass production techniques. Equally time-consuming and costly is the alteration of standard conduit sections. Moreover, since neither of the above techniques is normally carried out by the manufacturer or the construction crews involved in the installation of the conduit, the quality of the energy dissipating rings would be of lesser quality than could be expected for a standard production item.

Accordingly, it is a principal object of the present invention to provide an energy dissipator ring which can be installed in closed conduits by an installation procedure which is less costly than other methods of dissipating the energy of high water velocities.

An additional object of the present invention is to provide an energy dissipator ring whose position can be readily adjusted at the installation site by the construction crew so as to satisfy the needs of the particular installation.

It is also an object of the present invention to provide energy dissipator rings which, when damaged, can be easily replaced by simple and economical installation procedures.

In accordance with the invention, there is provided for installation in a closed conduit an energy dissipator ring which is comprised of a plurality of prefabricated ring sections. Between at least a pair of the ring sections an expansion device is provided for forcing apart the two sections so as to increase the circumference of the energy dissipator ring until it is frictionally locked in place in the conduit. Preferably a plurality of such energy dissipator rings are installed in an inclined conduit, the number and spacing of the rings being determined by the steepness of the slope, the size of the conduit and the desired maximum water velocity. Optionally, each ring may include a drainage notch on its outer arcuate surface to permit water to drain between the ring and the conduit wall against which it is forced, to prevent pooling.

In cross section, the ring may take several forms. It may, for example, be rectangular, trapezoidal, or concave in the uphill direction for inducing maximum water turbulence and hence maximum energy dissipation. In one form of the invention, each ring includes a plurality of circumferentially spaced plateaus or teeth, with the teeth of adjacent energy dissipator rings being purposely out of alignment so that the teeth of a given ring are aligned with the spaces between the teeth of an adjacent ring; again, to create maximum water turbulence and maximum energy dissipation. Since the energy dissipating rings of the present invention are prefabricated, they can be produced by standard production processes for maximum consistency in quality and least cost. By frictionally retaining the rings in place in the conduit, the standard production conduit need not be altered. Moreover, the number and position of the rings can be varied to meet the needs of the particular installation. They can be installed not only in reinforced concrete conduits, but also in corrugated metal pipe and other types of conduits. An additional advantage of the present invention is that if, in a particular situation, too few rings have been installed in the conduit so that the water velocity is still excessive, additional rings can readily be added.

Other objects and advantages of the invention will become apparent from the following detailed description with reference to the drawings, in which:

FIG. 1 is an exploded perspective view of an energy dissipator ring incorporating features of the present invention;

FIG. 2 is a cross section through a conduit and an energy dissipator ring installed therein prior to the placement of filler grout;

FIG. 3 is a cross section through the same conduit after the placing of filler grout;

FIG. 4 is a detailed view of one type of expansion device between two sections of the multi-sectioned dissipator ring of FIGS. 1–3;

FIG. 5 is a cross-section through the expansion device of FIG. 4 along lines 5—5;

FIG. 6 is a longitudinal section through a conduit in which several of the energy dissipator rings of FIGS. 1–3 have been installed, to show their effect upon the water flowing in the conduit;

FIG. 7 is an exploded perspective view of a modified energy dissipating ring in accordance with the present invention;

FIG. 8 is a cross-section through a conduit and an energy dissipating ring of the type shown in FIG. 7;

FIG. 9 is a cross-section similar to that of FIG. 8 and showing in addition behind the energy dissipating ring illustrated in FIG. 8, a second energy dissipating ring which is positioned behind it;

FIG. 10 is a longitudinal cross section through the conduit illustrated in FIG. 9 along the lines 10—10 to illustrate the relative positions of the pair of energy dissipating rings shown in FIG. 9 in the conduit;

FIG. 11 is an expanded illustration of a modified expansion device shown in FIG. 9;

FIG. 12 is an expanded view of the energy dissipating rings illustrated in FIG. 6 to show their cross section;

FIG. 13 is a similar view of a modified energy dissipating ring having a cross section which is concave in the direction from which water flows; and FIG. 14 is a cross-sectional illustration of an energy dissipating ring having a trapezoidal cross section.

Turning now to the drawings, an energy dissipating ring prefabricated in accordance with the present invention is illustrated in FIG. 1. It is seen to comprise several (in this case, three) arcuate sections 2 which are preferably although not necessarily made of precast concrete. Other materials which may be used include certain plastics, metals, etc. Two of the sections 2 have at one of their ends an alignment dowel 6 which fits into openings (not shown) at opposite ends of the third section 2. Each of the ring sections 2 is also provided with a drainage notch 5 so that when the ring is installed in the manner shown in FIG. 2, water will not pool above the ring, regardless of which of the ring sections is installed at the bottom of the conduit.

In accordance with the invention, the energy dissipator ring of FIG. 1 is retained frictionally in a conduit 8 by use of an expansion device shown generally in FIG. 2 and in more detail in FIGS. 4 and 5. In addition, the energy dissipator rings may be further secured in place by use of an epoxy cement, mortar, etc., between the ring and the inner wall of the conduit. The expansion device illustrated, which is only one of several forms which such a device may take, includes a threaded shaft 10 whose opposite ends extend into slot 7 at facing ends of two of the ring sections. A pair of nuts 12 travel on the threaded shaft 10 and between each nut 12 and the end of one of the ring sections 2 there is positioned on the shaft 10 a washer 14 and a bearing plate 16. By turning each nut 12 toward its associated bearing plate 16, the ring sections 2 against which the bearing plates 16 rest are forced apart, thus expanding the circumference of the ring and forcing it securely in position against the inner wall of the closed conduit 8.

To protect the dowels 6 and the expansion assembly from the corrosive effects of water in the conduit, a filler grout or asphalt mastic 4 is spread over them as shown in FIG. 3.

The effect of several spaced apart energy dissipator rings in a conduit upon the water flowing therein is illustrated in FIG. 6. At each ring the water velocity is cut down, and as a result the cross-sectional area of the conduit occupied by water is increased, as at 20 in FIG. 6, thus reducing the water velocity. As the water travels beyond an energy dissipating ring, its velocity gradually increases again, and with the progressively higher water velocity, the cross-sectional area of the water flow progressively diminishes to just before the next energy dissipating ring, as shown at 18. This recurring throttling of the water flow is very effective in reducing water velocity in an inclined conduit. To obtain maximum effectiveness, it may be necessary to experiment with the position of the several energy dissipating rings, and this is made particularly convenient with the present invention which permits the rings to be installed and checked prior to installation of the grouting, until the desired maximum velocity is not exceeded, at which time their installation may be made permanent by grouting the expansion device and the dowels.

The first embodiment of the energy dissipator ring described thus far has a substantially uniform cross section. The embodiment of the ring which is to be next described differs basically from the first embodiment in that its cross section is alternately thick and thin around its circumference. As best seen in FIG. 7, the modified energy dissipating ring is comprised of a plurality, specifically three, arcuate sections 24, each of them having a plurality of spaced-apart plateaus 26 separated by spaces 28. Dowels 6, such as shown in FIG. 1, may again be used to help align the sections 24 when the ring is expanded inside a conduit 8, as shown in FIG. 8. A slightly different form of expansion device 30 is shown generally in FIGS. 8 and 9 and in more detail in FIG. 11. In order to obtain maximum water turbulence and, hence, velocity loss, successive ones of the energy dissipating rings are so installed in the conduit 8 that the plateaus 26 of a given one of the rings are aligned with the bases 28 of an adjacent dissipator ring. This is best seen in FIG. 9, in which the plateaus 26*a* of a given energy dissipating ring *a* are seen to be positioned between the plateaus 26*b* of the next such ring *b*. The energy dissipating rings *a* and *b* are also shown in FIG. 10 in cross section, and it will be observed that the ring *b* is rotated relative to the ring *a* so that, whereas the section is through a thin portion 28*a* of the ring *a*, it is through a thick portion 26*b* of the ring *b*.

It can be seen that by this out-of-phase placement of alternate energy dissipating rings, a greater amount of turbulence is induced in the water, so as to diminish its velocity.

The modified expansion device 30, best seen in FIG. 11, includes a pair of threaded bolts 32 and 34 having a single threaded turnbuckle 36 between them. Each bolt 32 and 34 has welded on it a stop 38, and a bearing plate 40 is positioned between each stop 38 and the ring section 24 facing the stop. Rotating the turnbuckle 36 in the proper direction forces the bolts 32 and 34 to part, thereby spreading apart the sections 24.

In their simplest form, the ring sections in both FIGS. 1 and 7 are rectangular in cross section, as shown in FIG. 12. Alternatively, however, for greater water turbulence and greater energy dissipation, the ring sections may be concave in cross section so as to present a cupped surface 42 to the water stream illustrated by the arrow 44. This tends to have the effect of temporarily altering the direction of water flow for greater turbulence.

Another alternative, illustrated in FIG. 14, is to present a sloped surface 46 to the water flow; this being achieved by fabricating the sections of the ring with a trapezoidal cross section.

From the above, it will become apparent to those skilled in the art that the present invention provides a superior solution to the problem of excessive water velocity which occurs in large closed conduits placed on an incline.

What is claimed is:

1. For use in a closed water conduit, an energy dissipator ring comprising a a plurality of arcuate precast sections which together form said ring, said ring sections having inwardly extending circumferentially spaced-apart plateaus, and b an expansion assembly between at least a pair of said sections for increasing the circumference of said ring so as to permit said ring to be force-fitted in said conduit.

2. An inclined closed liquid-carrying conduit having a plurality of spaced-apart energy dissipator rings therein, each ring comprising:

a a plurality of prefabricated ring sections, and b an expansion device between at least two of said sections for forcing said two sections apart so as to increase the circumference of said ring until it is frictionally locked in place in said conduit.

3. The conduit of claim 2 characterized further in that said ring sections are precast concrete.

4. The conduit of claim 2 characterized further in that said rings are stepped in cross section so as to form inwardly extending circumferentially spaced-apart plateaus.

5. The conduit of claim 4 characterized further in that alternate ones of said rings are so positioned within said conduit that the plateaus of one ring are in alignment with the spaces between the plateaus of an adjacent ring.

6. The conduit of claim 2 characterized further in that each ring additionally includes structurally interfitting alignment means on at least two adjacent sections of said ring, and a drainage notch on at least one section of said ring.

* * * * *